US010919072B2

(12) United States Patent
Masters

(10) Patent No.: US 10,919,072 B2
(45) Date of Patent: Feb. 16, 2021

(54) PNEUMATIC PAINT BRUSH FEEDER APPARATUS

(71) Applicant: Mike Masters, Tijeras, NM (US)

(72) Inventor: Mike Masters, Tijeras, NM (US)

( * ) Notice: Subject to any disclaimer, the term of this patent is extended or adjusted under 35 U.S.C. 154(b) by 0 days.

(21) Appl. No.: 16/420,310

(22) Filed: May 23, 2019

(65) Prior Publication Data

US 2020/0368774 A1 Nov. 26, 2020

(51) Int. Cl.

| | |
|---|---|
| ***A46B 11/06*** | (2006.01) |
| ***A46B 15/00*** | (2006.01) |
| ***B05C 17/00*** | (2006.01) |

(52) U.S. Cl.

CPC ..... *B05C 17/003* (2013.01); *A46B 11/063* (2013.01); *A46B 15/0012* (2013.01); *A46B 2200/202* (2013.01); *B05C 17/002* (2013.01)

(58) Field of Classification Search

CPC ..... A46B 11/063; A46B 11/06; A46B 11/00; A46B 2200/202; A46B 2200/20; A46B 11/0072; A46B 15/00; A46B 15/0002; A46B 15/0004; A46B 15/0012; B05C 17/003; B05C 17/00; B05C 17/002

See application file for complete search history.

(56) References Cited

U.S. PATENT DOCUMENTS

| | | | | |
|---|---|---|---|---|
| 1,465,856 | A * | 8/1923 | Marsh | A46B 11/063 401/287 |
| 3,503,691 | A * | 3/1970 | Kirch | B05C 17/002 401/188 R |
| 4,639,156 | A | 1/1987 | Stern | |
| 4,790,679 | A | 12/1988 | Murphy | |
| 5,054,947 | A | 10/1991 | Frank | |
| 5,071,278 | A | 12/1991 | Chen | |
| D331,321 | S | 12/1992 | Gebaurer | |
| 5,904,434 | A | 5/1999 | Bekius | |
| 5,935,659 | A * | 8/1999 | Cane | B05B 9/047 222/95 |
| 8,430,592 | B2 | 4/2013 | Castellana | |
| 8,596,898 | B2 | 12/2013 | Walcot | |
| 10,039,369 | B2 * | 8/2018 | Haemerle | A46B 11/06 |

* cited by examiner

*Primary Examiner* — David J Walczak

(57) ABSTRACT

A pneumatic paint brush feeder apparatus for supplying paint on demand to a brush includes a paint container having a top side with a fill aperture extending through to a reservoir. A lid seals and alternatively unseals the fill aperture. A battery powered compressor is coupled to the paint container and an air line extends from a compressor tank into an intake aperture of the paint container to pressurize the reservoir. A hose extends through an outlet aperture of the paint container to deliver the paint to a distal end of the hose. A brush is coupled to the hose and has a delivery tube extending from a bottom end of a handle, through a head and into a plurality of bristles to deliver paint into the bristles. A button is coupled to the brush to prevent, or alternatively allow, the flow of paint to the bristles.

7 Claims, 6 Drawing Sheets

PNEUMATIC PAINT BRUSH FEEDER APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to paint brushes and more particularly pertains to a new paint brush for supplying paint on demand to a brush.

BRIEF SUMMARY OF THE INVENTION

An embodiment of the disclosure meets the needs presented above by generally comprising a paint container having a front wall separated from a back wall, a left wall separated from a right wall, and a bottom wall separated from a top wall forming a reservoir. The top side has a fill aperture extending through to the reservoir. The fill aperture is configured to receive paint to fill the reservoir. The top wall has a threaded lip extending around the fill aperture. A lid is threaded and is selectively engageable with the lip to seal and alternatively unseal the fill aperture. A compressor is coupled to the paint container and has a compressor motor, a compressor tank, and a plurality of controls. The plurality of controls engages and alternatively disengages the compressor motor and limits the amount of pressure created in the compressor tank. An air line is coupled to the compressor and extends from the compressor tank into an intake aperture of the paint container. The air line is in fluid communication with the compressor tank and the reservoir to pressurize the reservoir. A battery is coupled to the compressor and is in operational communication with the compressor motor. A hose is coupled to the paint container. The hose extends through an outlet aperture of the paint container and is in fluid communication with the reservoir. The hose is configured to deliver the paint to a distal end of the hose. A brush is coupled to the hose. The brush has a handle, a head coupled to the handle, and a plurality of bristles coupled to the head. The brush has a delivery tube extending from a bottom end of the handle, through the head and into the bristles. The delivery tube is in fluid communication with the hose and is configured to deliver paint into the bristles. A button is coupled to the brush. The button is coupled to the handle adjacent the head and is in operational communication with the delivery tube to prevent, or alternatively allow, the flow of paint to the bristles.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
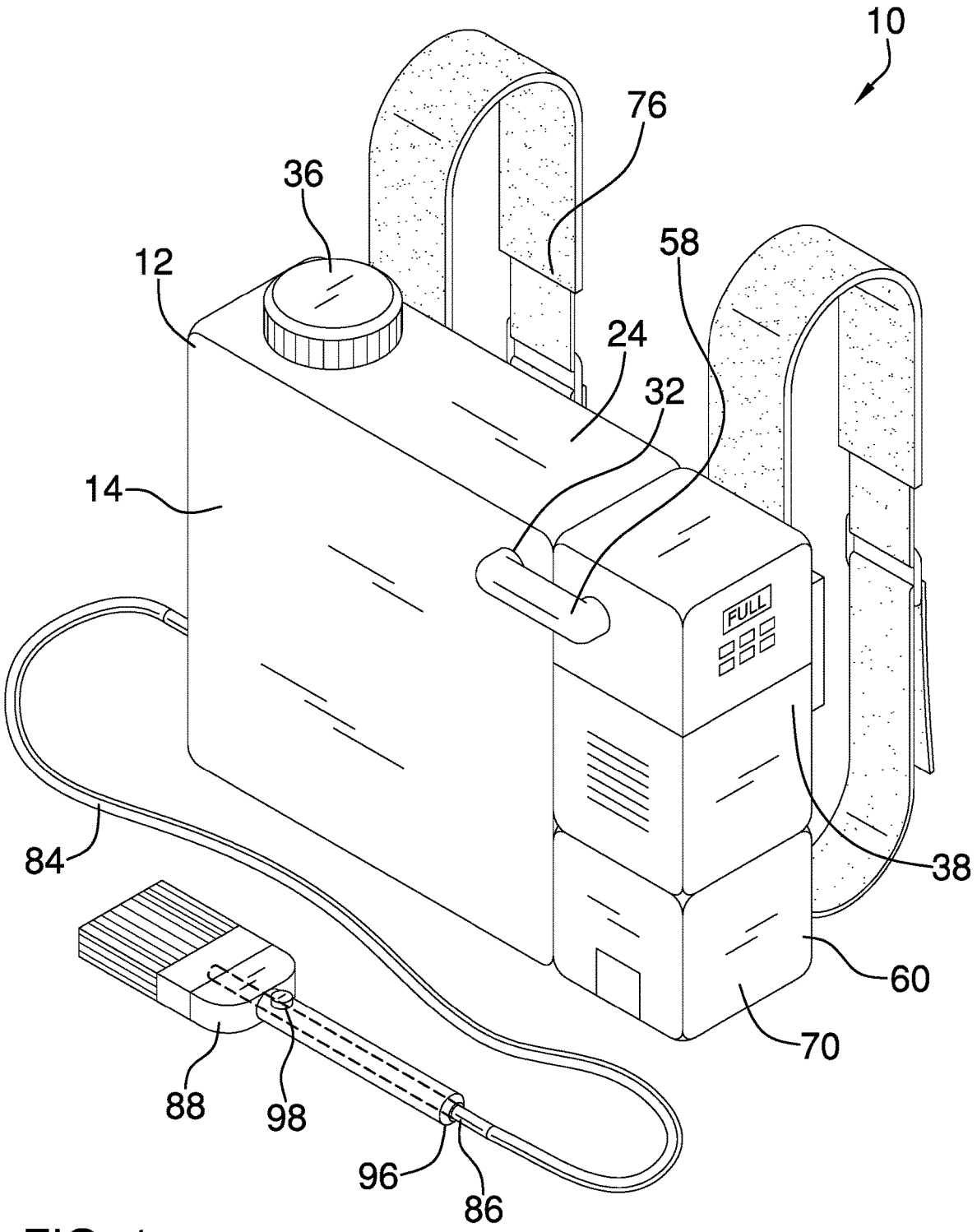
FIG. 1 is an isometric view of a pneumatic paint brush feeder apparatus according to an embodiment of the disclosure.
Figure 2:
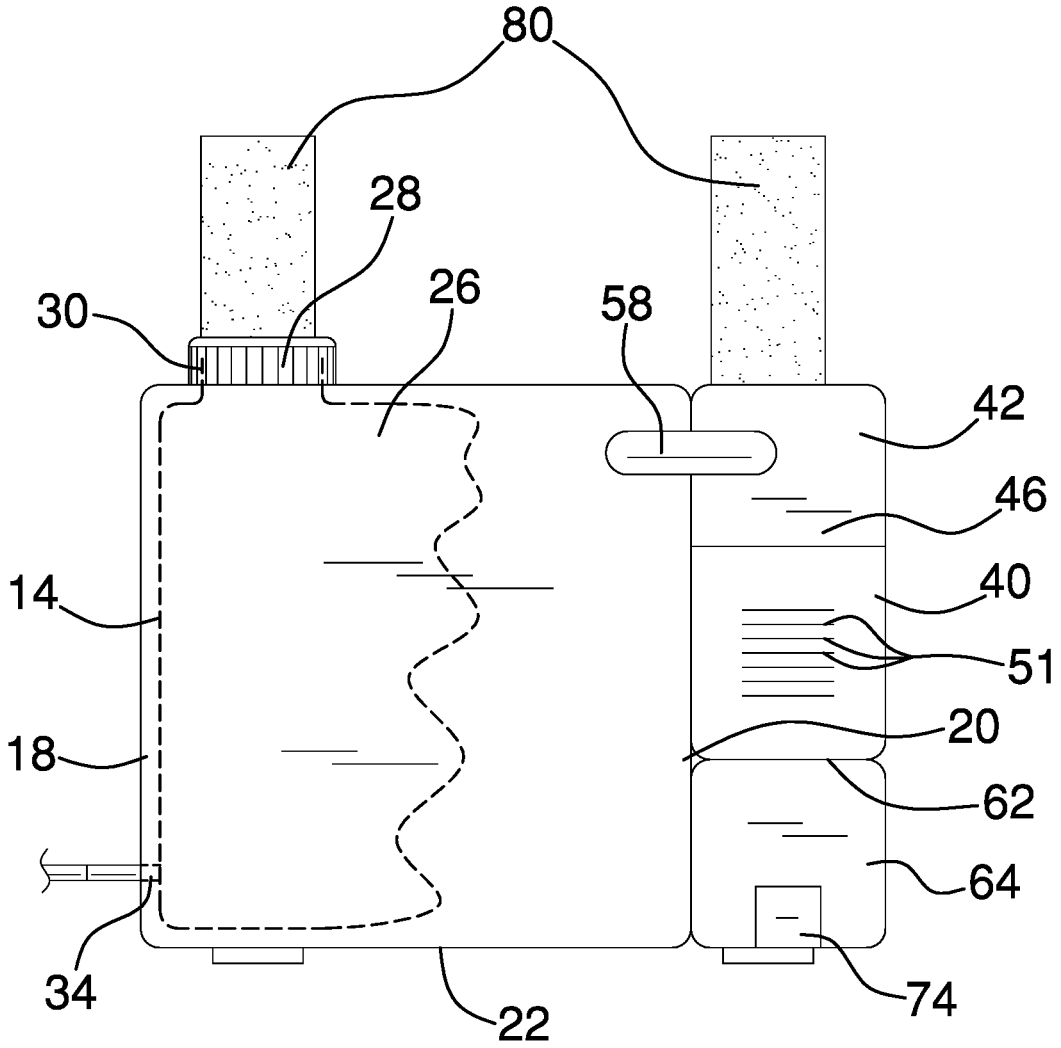
FIG. 2 is a front elevation view of an embodiment of the disclosure.
Figure 3:
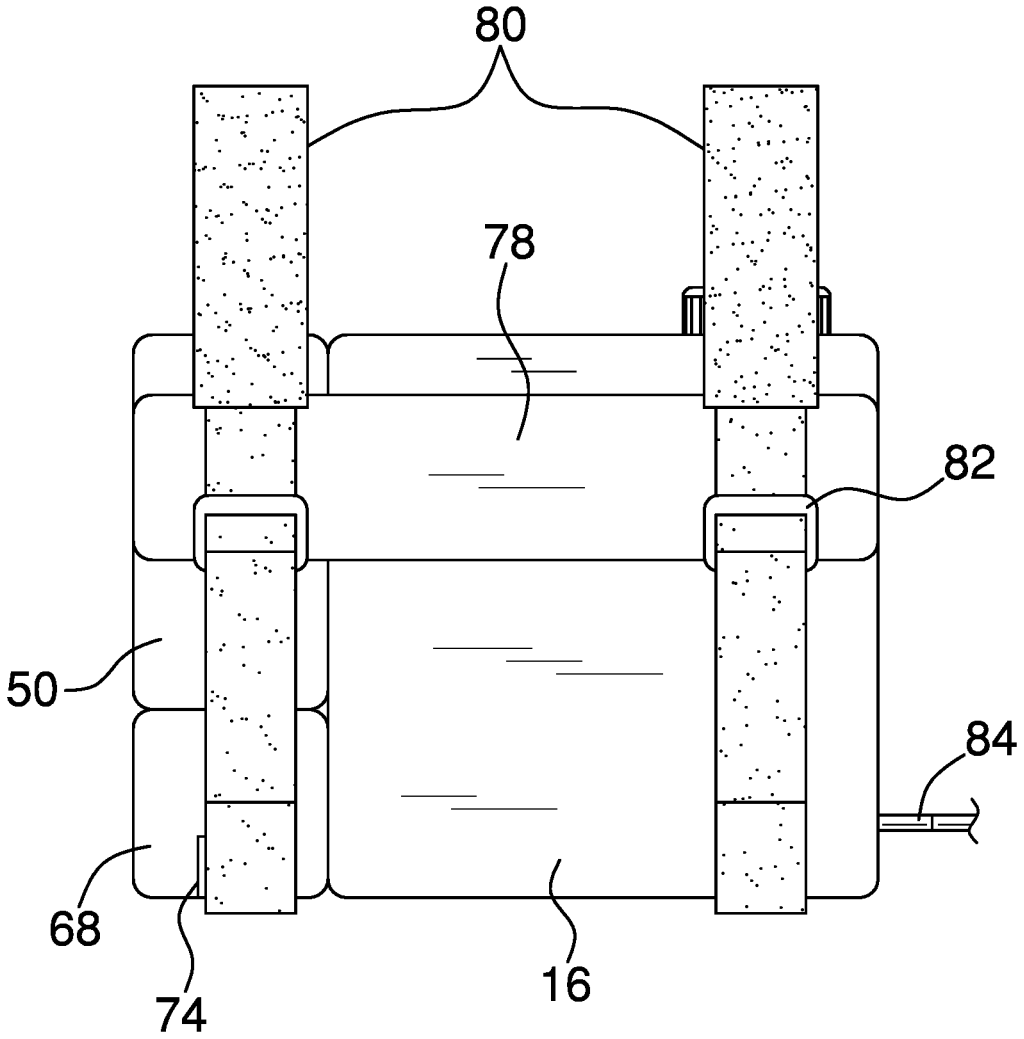
FIG. 3 is a rear elevation view of an embodiment of the disclosure.
Figure 4:
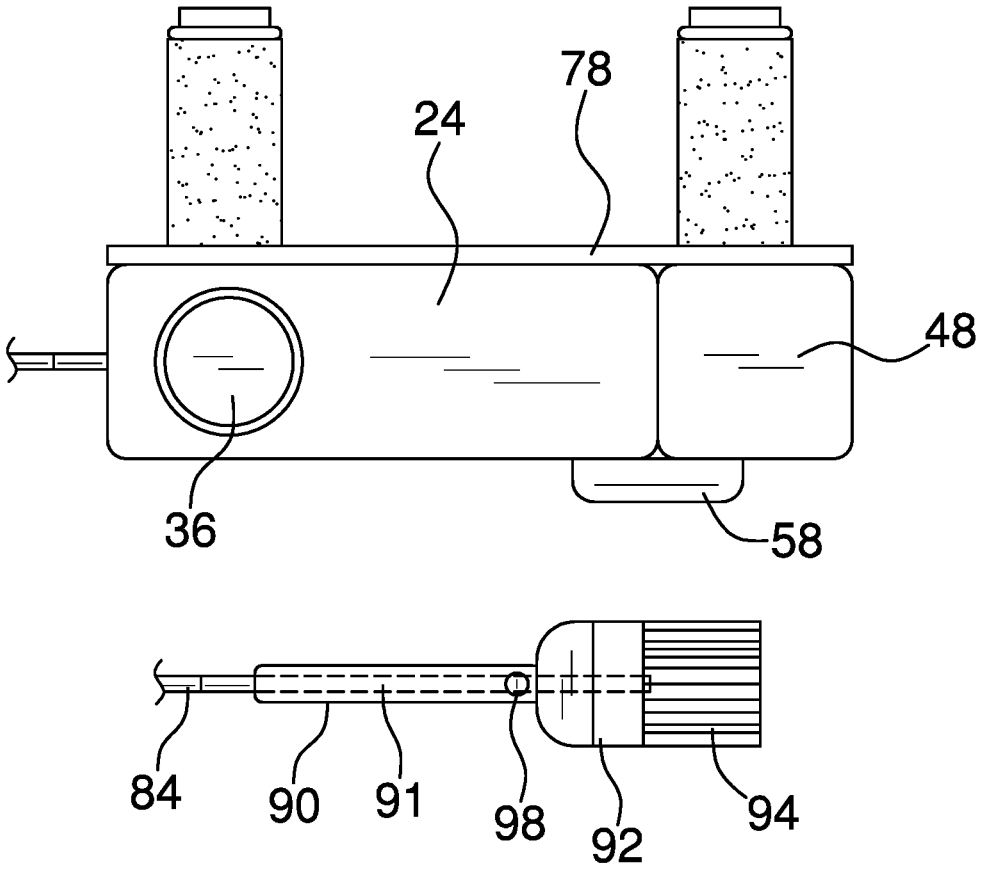
FIG. 4 is a top plan view of an embodiment of the disclosure.
Figure 5:
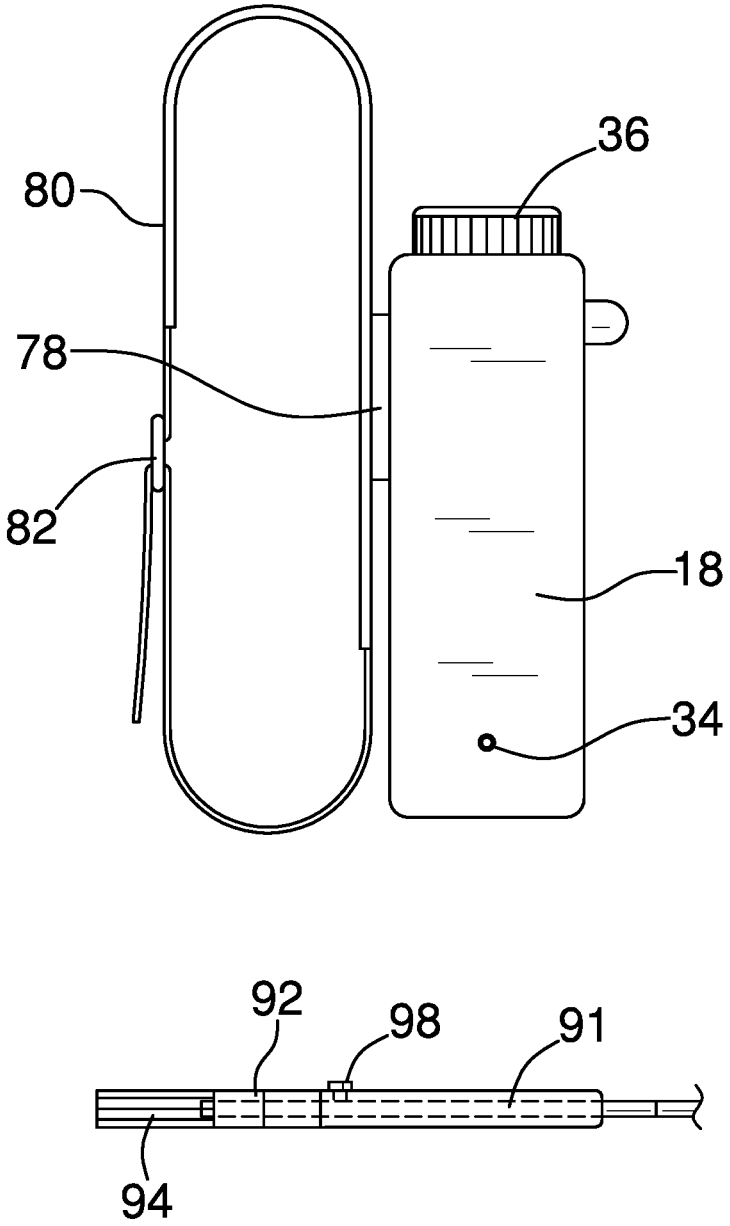
FIG. 5 is a left elevation view of an embodiment of the disclosure.
Figure 6:
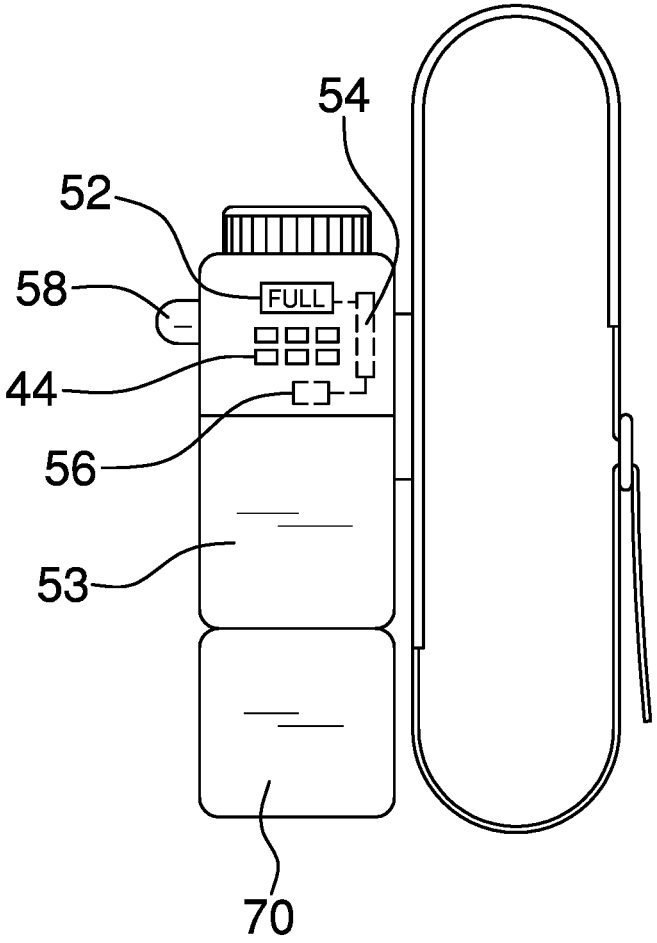
FIG. 6 is a right elevation view of an embodiment of the disclosure.

With reference now to the drawings, and in particular to FIGS. 1 through 6 thereof, a new paint brush embodying the principles and concepts of an embodiment of the disclosure and generally designated by the reference numeral 10 will be described.

As best illustrated in FIGS. 1 through 6, the pneumatic paint brush feeder apparatus 10 generally comprises a paint container 12 having a front wall 14 separated from a back wall 16, a left wall 18 separated from a right wall 20, and a bottom wall 22 separated from a top wall 24 forming a reservoir 26. The top wall 24 has a fill aperture 28 extending through to the reservoir 26 and configured to receive paint to fill the reservoir 26. The top wall 24 has a threaded lip 30 extending around the fill aperture 28. The front wall 14 has an intake aperture 32 extending through to the reservoir 26 proximal the top wall 24 and the left wall 18 has an outlet aperture 34 extending through to the reservoir 26 proximal the bottom wall 22. A threaded lid 36 is selectively engageable with the lip 30 to seal and alternatively unseal the fill aperture 28.

A compressor 38 is coupled to the paint container 12. The compressor 38 has a compressor motor 40, a compressor tank 42, and a plurality of controls 44. The compressor 38 may be rectangular prismatic and coupled to the right wall 20 of the paint container. The compressor has a front side 46, a top side 48, and a back side 50 coplanar with the front wall 14, the top wall 24, and the back wall 16 of the paint container, respectively. The front side 46 of the compressor motor has a plurality of intake vents 51. The plurality of controls 44 engages and alternatively disengaging the compressor motor 40 and limits the amount of pressure created in the compressor tank 42. The plurality of controls 44 is coupled to a right side 53 of the compressor. The compressor 38 may have an LCD screen 52 coupled above the plurality of controls 44. The LCD screen 52 is in operational communication with a CPU 54 that is in turn in operational communication with a pressure sensor 56 of the compressor to display the pressure level of the compressor tank 42 on the LCD screen 52. An air line 58 is coupled to the compressor 38 and extends from the compressor tank 42 into the intake aperture 32 of the paint container. The air line 58 is in fluid communication with the compressor tank 42 and the reservoir to pressurize the reservoir 26.

A battery 60 is coupled to the compressor 38 and is in operational communication with the compressor motor 40. The battery may also be rectangular prismatic and is selectively engageable with a bottom side 62 of the compressor adjacent the right wall 20 of the paint container. The battery 60 has a front face 64, a bottom face , and back face 68 coplanar with the front wall 14, the bottom wall 22, and the back wall 16 of the paint container, respectively. The battery 60 has a right face 70 coplanar with a right side 53 of the compressor. The battery 60 has a pair of release levers 74 to disengage the battery 60 from the compressor motor 40 to allow for charging and replacement.

A harness 76 is coupled to the paint container 12 and the compressor 38. The harness 76 has a mounting platform 78 and a pair of straps 80 coupled to the mounting platform 76. The mounting platform 78 is coupled to the back wall 16 of the paint container and the back side 50 of the compressor and extends from adjacent the left wall 18 of the paint container to adjacent the right side 53 of the compressor. Each of the pair of straps 80 has an adjustment mechanism 82 and is configured to be worn like a backpack.

A hose 84 is coupled to the paint container 12 and extends through the outlet aperture 34 of the paint container and is in fluid communication with the reservoir 26. The hose 84 is configured to deliver the paint to a distal end 86 of the hose. A brush 88 is coupled to the hose 84. The brush 88 has a handle 90, a head 92 coupled to the handle 90, and a plurality of bristles 94 coupled to the head 92. The brush 88 has a delivery tube 91 extending from a bottom end 96 of the handle, through the head 92 and into the bristles 94. The delivery tube 90 is in fluid communication with the distal end 86 of the hose and is configured to deliver paint into the bristles 94. A button 98 is coupled to the handle 90 adjacent the head 92 for easy operation with a user's thumb. The button 98 is in operational communication with the delivery tube 90 to prevent, or alternatively allow, the flow of paint to the bristles 94.

In use, the reservoir 26 is filled through the fill aperture 28 and the lid 36 is then engaged with the lip 30. The plurality of controls 44 is then used to control the compressor 38 to create the desired pressure. Once the brush 88 is secured and touched to the surface to be painted, the button 98 is used to control the flow of paint as needed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pneumatic paint brush feeder apparatus comprising:

a paint container, the paint container having a front wall separated from a back wall, a left wall separated from a right wall, and a bottom wall separated from a top wall forming a reservoir, the top wall having a fill aperture extending through to the reservoir and configured to receive paint to fill the reservoir, the top wall having a threaded lip extending around the fill aperture;

a lid coupled to the paint container, the lid being threaded and selectively engageable with the lip to seal and alternatively unseal the fill aperture;

a compressor coupled to the paint container, the compressor having a compressor motor, a compressor tank, and a plurality of controls, the plurality of controls engaging and alternatively disengaging the compressor motor and limiting the amount of pressure created in the compressor tank;

an air line coupled to the compressor, the air line extending from the compressor tank into an intake aperture of the paint container, the air line being in fluid communication with the compressor tank and the reservoir to pressurize the reservoir;

a battery coupled to the compressor, the battery being in operational communication with the compressor motor;

a hose coupled to the paint container, the hose extending through an outlet aperture of the paint container and in fluid communication with the reservoir, the hose being configured to deliver the paint to a distal end of the hose;

a brush coupled to the hose, the brush having a handle, a head coupled to the handle, and a plurality of bristles coupled to the head, the brush having a delivery tube extending from a bottom end of the handle, through the head and into the bristles, the delivery tube being in fluid communication with the hose and configured to deliver paint into the bristles;

a button coupled to the brush, the button being coupled to the handle adjacent the head, the button being in operational communication with the delivery tube to prevent, or alternatively allow, the flow of paint to the bristles; and wherein the compressor is rectangular prismatic and coupled to the right wall of the paint container, the compressor having a front side, a top side, and a back side coplanar with the front wall, the top wall, and the back wall of the paint container, respectively, the battery being rectangular prismatic and coupled to a bottom side of the compressor adjacent the right wall of the paint container, the battery having a front face, a bottom face, and back face coplanar with the front wall, the bottom wall, and the back wall of the paint container, respectively, the battery having a right face coplanar with a right side of the compressor.

2. The pneumatic paint brush feeder apparatus of claim 1 further comprising a harness coupled to the paint container and the compressor, the harness having a mounting platform and a pair of straps coupled to the mounting platform, the mounting platform being coupled to the back wall of the paint container and the back side of the compressor, the pair of straps being configured to be worn like a backpack.

3. The pneumatic paint brush feeder apparatus of claim 2 further comprising the mounting platform extending from adjacent the left wall of the paint container to adjacent the right side of the compressor, each of the pair of straps having an adjustment mechanism.

4. The pneumatic paint brush feeder apparatus of claim 1 further comprising the intake aperture extending through the front wall proximal the top wall and the outlet aperture extending through the left wall proximal the bottom wall.

5. The pneumatic paint brush feeder apparatus of claim 1 further comprising the plurality of controls being coupled to a right side of the compressor, the compressor having an LCD screen coupled above the plurality of controls, the LCD screen being in operational communication with a CPU, the CPU being in operational communication with a pressure sensor of the compressor to display the pressure level of the compressor tank on the LCD screen.

6. The pneumatic paint brush feeder apparatus of claim 1 further comprising the battery having a pair of release levers, the pair of release levers disengaging the battery from the compressor motor to allow for charging and replacement.

7. A pneumatic paint brush feeder apparatus comprising:

a paint container, the paint container having a front wall separated from a back wall, a left wall separated from a right wall, and a bottom wall separated from a top wall forming a reservoir, the top wall having a fill aperture extending through to the reservoir and configured to receive paint to fill the reservoir, the top wall having a threaded lip extending around the fill aperture, the front wall having an intake aperture extending through to the reservoir proximal the top wall and the left wall having an outlet aperture extending through to the reservoir proximal the bottom wall;

a lid coupled to the paint container, the lid being threaded and selectively engageable with the lip to seal and alternatively unseal the fill aperture;

a compressor coupled to the paint container, the compressor having a compressor motor, a compressor tank, and a plurality of controls, the compressor being rectangular prismatic and coupled to the right wall of the paint container, the compressor having a front side, a top side, and a back side coplanar with the front wall, the top wall, and the back wall of the paint container, respectively, the plurality of controls engaging and alternatively disengaging the compressor motor and limiting the amount of pressure created in the compressor tank, the plurality of controls being coupled to a right side of the compressor, the compressor having an LCD screen coupled above the plurality of controls, the LCD screen being in operational communication with a CPU, the CPU being in operational communication with a pressure sensor of the compressor to display the pressure level of the compressor tank on the LCD screen;

an air line coupled to the compressor, the air line extending from the compressor tank into the intake aperture of the paint container, the air line being in fluid communication with the compressor tank and the reservoir to pressurize the reservoir;

a battery coupled to the compressor, the battery being in operational communication with the compressor motor, the battery being rectangular prismatic and selectively engageable with a bottom side of the compressor adjacent the right wall of the paint container, the battery having a front face, a bottom face, and back face coplanar with the front wall, the bottom wall, and the back wall of the paint container, respectively, the battery having a right face coplanar with the right side of the compressor, the battery having a pair of release levers, the pair of release levers disengaging the battery from the compressor motor to allow for charging and replacement;

a harness coupled to the paint container and the compressor, the harness having a mounting platform and a pair of straps coupled to the mounting platform, the mounting platform being coupled to the back wall of the paint container and the back side of the compressor, the mounting platform extending from adjacent the left wall of the paint container to adjacent the right side of the compressor, each of the pair of straps having an adjustment mechanism and being configured to be worn like a backpack;

a hose coupled to the paint container, the hose extending through the outlet aperture of the paint container and in fluid communication with the reservoir, the hose being configured to deliver the paint to a distal end of the hose;

a brush coupled to the hose, the brush having a handle, a head coupled to the handle, and a plurality of bristles coupled to the head, the brush having a delivery tube extending from a bottom end of the handle, through the head and into the bristles, the delivery tube being in fluid communication with the hose and configured to deliver paint into the bristles; and a button coupled to the brush, the button being coupled to the handle adjacent the head, the button being in operational communication with the delivery tube to prevent, or alternatively allow, the flow of paint to the bristles.

* * * * *